United States Patent [19]

Myklebust et al.

[11] Patent Number: 4,925,317

[45] Date of Patent: May 15, 1990

[54] FLEXIBLE CONTAINER HAVING IMPROVED LIFTING LOOPS

[75] Inventors: Eirik Myklebust; Bjarne Omdal; Anders Juel; Olaf Strand, all of Porsgrunn, Norway; Erik Jonsgard, Hong Kong, Hong Kong

[73] Assignee: Norsk Hydro a.s., Oslo, Norway

[21] Appl. No.: 238,812

[22] Filed: Aug. 31, 1988

[30] Foreign Application Priority Data

Aug. 31, 1987 [NO] Norway ..... 873663
Jul. 22, 1988 [NO] Norway ..... 883257

[51] Int. Cl.[5] ..... B65D 33/06

[52] U.S. Cl. ..... 383/8; 383/13; 383/15; 383/98

[58] Field of Search ..... 383/8, 13, 15, 98, 99

[56] References Cited

U.S. PATENT DOCUMENTS 3,125,281 3/1964 Woolen ..... 383/8
4,312,392 1/1982 Sekiguchi ..... 383/8
4,781,470 11/1988 Myklebust et al. ..... 383/8

FOREIGN PATENT DOCUMENTS 0026287 4/1981 European Pat. Off. ..... 383/7
0026288 4/1981 European Pat. Off. ..... 383/7
0047389 3/1982 European Pat. Off. ..... 383/8
1557784 12/1979 United Kingdom ..... 383/8

*Primary Examiner*—Stephen P. Garbe
*Attorney, Agent, or Firm*—Wenderoth, Lind & Ponack

[57] ABSTRACT

A flexible intermediate container has at least one improved lifting loop formed by joining integral extensions of a side wall structures. The extensions are at their upper free ends cut to form at least two flaps which are positioned above or below the extensions on both sides of a folding line or seam, thus forming a lifting loop joint comprising frictional area of overlapping layers of fabric material. Friction therebetween is secured by a frictional agent such 2500 glue or hot-melt and/or by a mechanical device. The lifting loop can be gathered together and surrounded by at least one band or sleeve.

19 Claims, 4 Drawing Sheets

FLEXIBLE CONTAINER HAVING IMPROVED LIFTING LOOPS

BACKGROUND OF THE INVENTION

The present invention relates to intermediate bulk containers made from fabric material and having improved lifting loops. Such a container includes side walls, at least one lifting loop, which is formed by joining extensions which are integral with the side wall structure, and a base structure.

Such containers are generally manufactured from at least one piece of woven fabric, particularly woven polypropylene or other suitable synthetic material, and are required to carry loads of 500 kg or more with a considerable safety margin. The containers are used for storage and transport of bulk material in granular, power or paste forms. Fabric extensions used for making the lifting loops are integral, continuous extensions of the side walls, but obviously such extensions can be separate pieces of fabric material joined to the side walls by seams.

During handling of the containers, both the lifting loops and the base construction must absorb the resulting stress from static and dynamic loads. The wall structure, however, needs only to absorb the static load during stacking of the container. The lifting loops are the element of the construction which must absorb the highest loads during handling. Strong lifting loops are accordingly the most essential features for a competitive container.

To date such loops have been formed by joining the integral extensions by the fast and inexpensive method of sewing. Tests involving several types of seams proved it impossible to increase the strength of the loop joints substantially unless the fabric strength was increased, thereby requiring heavier and more expensive fabric. Improved sewing techniques have resulted in ever stronger seams, but in spite of that, loops including seams are still weaker than loops formed as continuous integral extensions of the wall structure, i.e. no seams in the loop itself. However strong such presently known loops seem, they constitute a weak part of the container and should accordingly be improved.

Great success has been achieved with the containers according to U.S. Pat. No. 4,136,723 and which have continuous integral lifting loops and seams in the wall and base structure. An alternative arrangement comprises integral extensions of the side wall structure joined by seams to form lifting loops. But these loops are not as strong as the former ones due to the seams.

When two side wall extensions are joined by a seam to form a lifting loop, it is necessary to place the seam somewhat below the extremes of such extensions, for instance about 10 cm. Then the two fabric parts above the seam are folded down at one side of the seam, and the loop is gathered together to form a lifting portion or handle. This way of joining the extensions implies that there will be one layer of fabric on one side of the seam and three layers on the other. Consequently, the seam will be directly exposed to lifting stress during handling of the container, and the lifting loop will tend to slide on the lifting means due to the 1:3 distribution of the layers of fabric around the seam. A further consequence is that when a loop is gathered together to form a lifting portion, such portion or area will not have even thickness.

SUMMARY OF THE INVENTION

An object of the present invention is to provide a container with improved lifting loops made by joining extensions of the side wall structure. More specifically the stress the joints are exposed to should be made substantially equal at every point of the joint, and the joints themselves should be relieved of as much stress as possible.

A further object is to provide that the containers having such improved lifting loops should be compatible with conventional filling and handling equipment for existing containers.

Manufacture of the improved joints should be possible without complicating the present manufacturing process or requiring specialized and expensive manufacturing equipment for the containers.

To meet the above objects the inventors had to find ways to increase the load carrying capacity of the lifting loops. As further increase of the capacity of the seams already was exhausted, it was necessary to find ways to transfer loads from the joints, and actually to relieve the seams of stress.

From the EP-patent application No. 84 102 195.9 it is known to manufacture a container having permanent preformed lifting handles by folding, gathering or pressing the lifting loops together at the lifting area. A sleeve of flexible material can also surround this area.

Normal procedure for placing such sleeve around the lifting loops has been to fold the ends of the extensions of the side wall structure above the joining seam to one side before fitting the sleeve around the seam.

However, the lifting handle thus produced had a tendency to become "lopsided", as three layers of fabric were gathered together at one half of the lifting area against only one layer at the other.

In order to improve the lifting handle and thereby the lifting loop, the inventors divided the fabric parts (flaps) of the extensions above the joining seam into two halves, and folded pairs of one half to each side before the lifting loop was gathered together. The surprising effect of this modification was a small but consistent increase of the load carrying capacity.

The only rational explanation seemed to be that the stress had been more evenly distributed over the entire length of the seam. Further, the friction between overlapping parts of fabric transferred some stress from one part of the lifting loop to the other. This also contributed to the reduction of stress acting on the seam.

To further increase the frictional forces, the inventors cut the fabric parts of the extensions above the seams at several places, thus forming several flaps which were folded in pairs alternatingly to opposite respective sides before gathering the lifting loops together at the lifting area. The use of a frictional agent such as hot-melt, glue etc. in an area between the fabric of the folded flaps and the fabric below the seam, further increased the strength of the lifting loop.

The inventors pursued utilization of the frictional forces for relieving the seam of stress. It was found that by arranging the flaps in a different way there could be obtained a larger area on which the frictional forces could act. This alternative embodiment comprised arranging the flaps to alternately overlap the uncut parts of the extensions over and under a folding line. The flaps could then be fastened to the uncut parts of the extensions by glue, hot-melt and/or seams.

However, as a number of flaps may complicate the manufacturing process, the inventors found that the concept of utilizing frictional forces between overlapping layers could also be used if the application of a seam was somewhat modified. A new seam arrangement implied that by omitting the subdivision of the two extensions into two or more flaps, each of the two side wall extensions needed to have one flap only. Also in this case will both flaps rest adjacent the opposite extensions, and the friction forces between overlapping flap and extension will relieve the seam itself of stress, and accordingly strengthen the joint.

One advantage of the new joints, i.e. utilization of friction between fabric layers in the lifting loop, is that application of a sleeve according to the above EP-patent application can be secured more tightly around the lifting area. Accordingly, the friction forces between the area of fabric layers will increase and thereby give an even stronger lifting loop.

However, the friction forces between flap and extension can be further increased by applying a frictional agent or lightly fitting bands on each side to increase the friction between fabric layers and thereby relieve the connecting seam of stress.

BRIEF DESCRIPTION OF THE DRAWINGS

In order to explain the invention more completely, the manufacture of various embodiments of improved joints for lifting loops will be described in more detail with reference to the accompanying drawings.

DETAILED DESCRIPTION OF THE INVENTION

Figure 1:
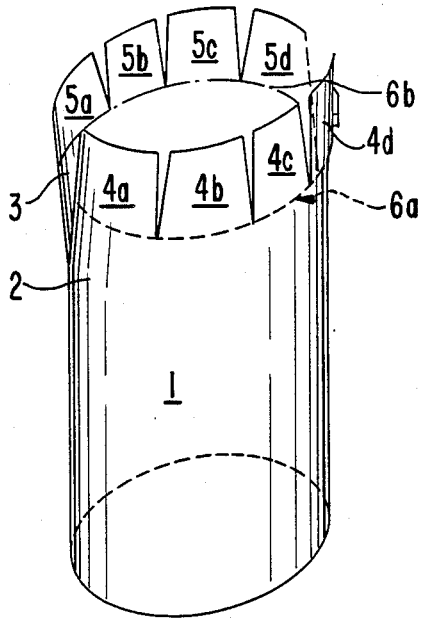
FIG. 1 is a perspective view of a cut tubular blank slit to form multiple flaps.

FIG. 1 shows a cut blank of tubular fabric which has been cut at one end to form two integral extensions 2 and 3 of the side wall structure 1, each of which has been slit to form four flaps 4*a–d* and 5*a–d*.

Figure 2:
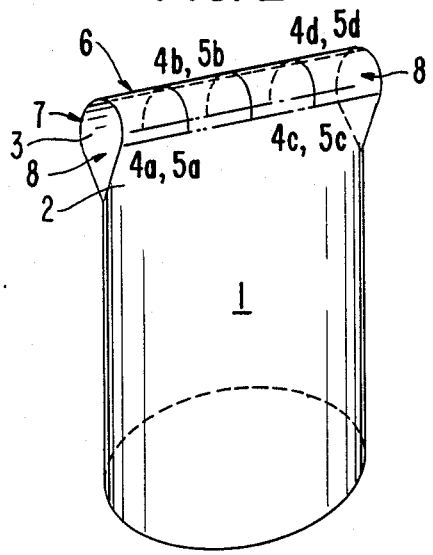
FIG. 2 is a perspective view of the top of a container made from the blank of FIG. 1.

The extensions 2 and 3 are joined together along a seam 6 (FIG. 2) at positions corresponding to the inner ends or extents of the flaps, i.e. at positions that differentiate the flaps from the remainder of the respective extensions. Such positions are indicated in FIG. 1 by dashed line 6*a* for flaps 4*a–d* and by dashed line 6*b* for flaps 5*a–d*. Thus, such lines are imaginary but indicate positions of the unjoined extensions 2 and 3 in FIG. 1 to be joined to form the seam 6 shown in FIG. 2. Also, the pairs of flaps are fit together in an alternating manner as shown in FIG. 2. Thus, flaps 4*a* and 4*c* overlap the inner surface of the remainder of extension 3, and flaps 4*b* and 4*d* overlap the outer surface of the remainder of extension 3. Similarly, the flaps 5*a* and 5*c* overlap the outer surface of the remainder of extension 2, and flaps 5*a* and 5*c* overlap the outer surface of the remainder of extension 2. As a result, the outer ends of all of flaps 4*a–d* are aligned linearly, but with flaps 4*a* and 4*c* inwardly and with flaps 4*b* and 4*d* outwardly of the remainder of extension 3. In a similar manner, the outer ends of all of flaps 5*a–d* are aligned linearly, but with flaps 5*a* and 5*c* outwardly and with flaps 5*b* and 5*d* inwardly of the remainder of extension 2.

Figure 6:
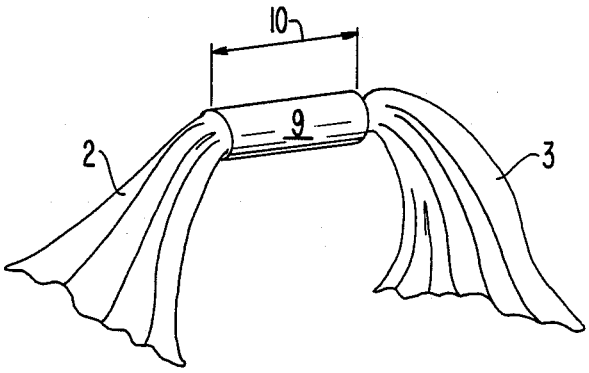
FIG. 6 is a perspective view of a completed lifting loop including a sleeve.

The two extensions 2, 3 a side wall structure form the lifting loop 7 with openings 8 for insertion of suitable lifting means. The lifting loop 7 is gathered, folded and pressed together at a lifting area to form a lifting handle, and at least one band is tightly wrapped around the lifting handle to maintain the complete joint in a compressed state. The resulting arrangement is shown in FIG. 6. In a preferred arrangement a protective sleeve 9 having a width 10 covers the complete joint including the flaps 4 and 5.

Figure 3:
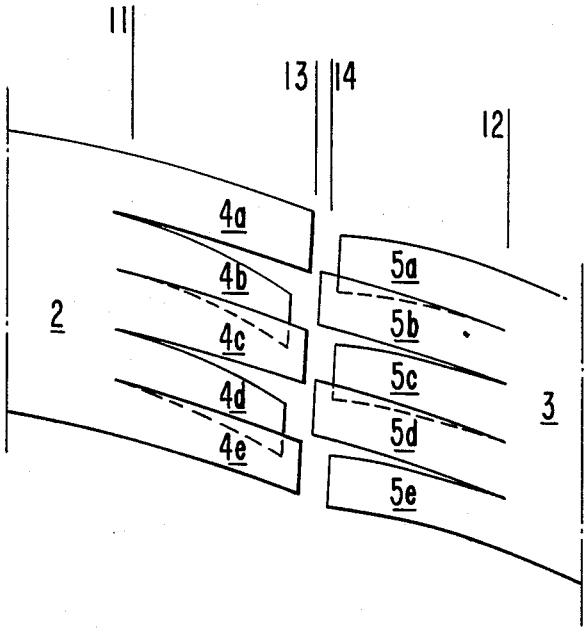
FIG. 3 is a schematic view in detail of the cut flaps at free ends of extensions of a side wall structure.

The flaps 4*a–e* and 5*a–e* of the integral extensions 2 and 3 of the side wall structure are shown more clearly in FIG. 3 and are arranged alternatingly on each side of a folding line and interconnected by placing in pairs opposing flaps 4*a* over 5*a*, 5*b* over 4*b*, 4*c* over 5*c*, 5*d* over 4*d* and 4*e* over 5*e* before joining the extensions 2 and 3 together. The extension 2 is cut between the lines 11 and 13, defining respectively the inner and outer ends of the flaps 4*a–e*. Extension 3 is cut likewise between lines 12 and 14 defining respectively the inner and outer ends of flaps 5*a–e*.

Figure 4:
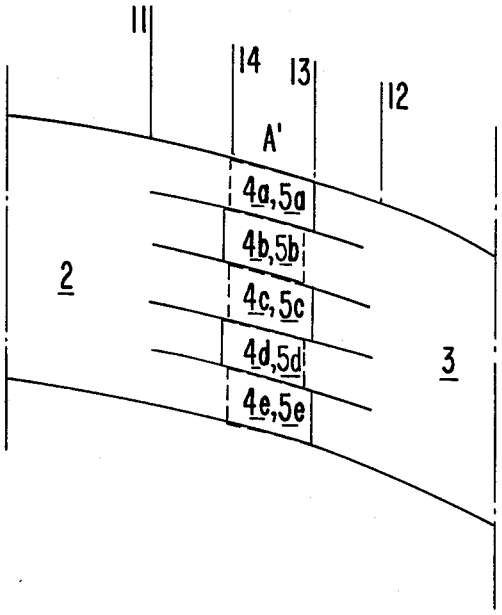
FIG. 4 is a similar view in detail of the arrangement of interconnecting flaps on each side of a folding line.

FIG. 4 shows a lifting loop joint made by a partly overlapping flaps 4*a–e* and 5*a–e*. In this case the joint itself, comprising a friction area A′ between lines 14 and 13, consists of overlapping of portions only of the flags.

Figure 5:
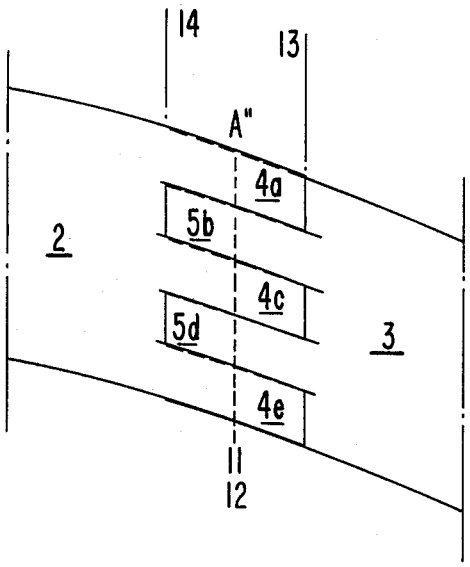
FIG. 5 is a similar view of an alternative arrangement of interconnecting the flaps shown in FIG. 3.

FIG. 5 shows the lifting loop joint made by completely overlapping the respective flaps. In this case the flaps also overlap portions of the uncut parts of the extensions 2,3. Glue or hotmelt can be placed between overlapping fabric material in a friction area A″ between lines 14 and 13. In this case the lines 11,12 will form a center line of the lifting joint. Comparing the joints of FIGS. 4 and 5, $A'' > A'$.

Figure 7:
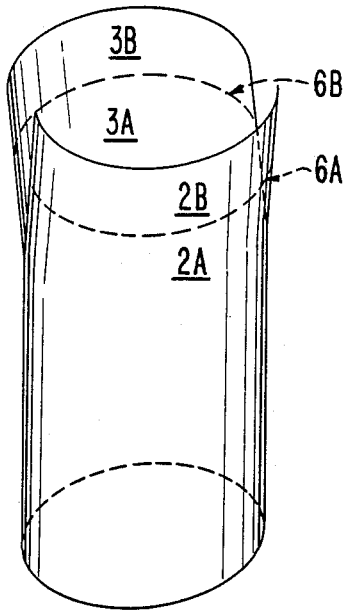
FIG. 7 is a perspective view of a cut tubular blank slit to form two flaps.

FIG. 7 shows a cut blank of tubular fabric which has been slit at one end to form two extensions 2 and 3 integral with the side wall structure 1. Extensions 2 and 3 each have single respective flaps 2B and 3B and integral extensions 2A and 3A defined by positions 6A and 6B to be folded and joined to form a seam 6′ (FIG. 1) which will close the upper part of the container.

Figure 8:
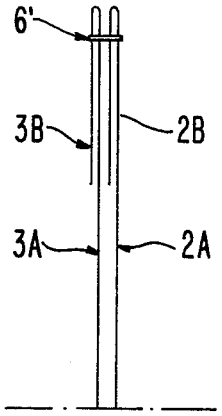
FIG. 8 is a schematic view showing how the top of the cut blank of FIG. 7 can be folded to be joined together at a seam.

FIG. 8 shows how the flaps 2B,3B and the extensions 2A, 3A can be folded and joined at seam 6′.

Figure 9:
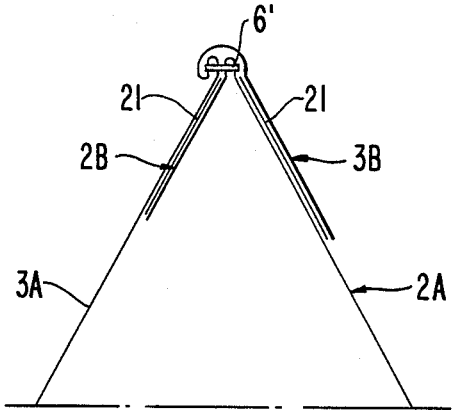
FIG. 9 is a schematic view showing how flaps of FIG. 8 can be secured to side wall extensions.

FIG. 9 shows completion of the lifting loop joint. Flap 3B is folded over the seam 6′ and secured to the extension 2A by a friction agent or mechanical means 21, e.g. a zig-zag seam while flap 2B is secured likewise to the extension 3A. Thereby, there are formed two friction areas which will relieve the seam 6′ of stress during lifting of the container.

EXAMPLE 1

This example relates to containers according to FIGS. 7–9. Comparison tests were carried out between containers made according to the invention having frictional areas between flaps and extensions of the side walls and corresponding containers without these frictional areas, that is having been joined in a conventional manner. The test containers were all produced at a test station from identical woven polypropylene (PP) fabric to identical main dimensions of 180×230 cm.

The containers were first filled with approx. 800 kg of a free-flowing plastic material and then placed in a 100 kN suspension "A"-frame test apparatus.

A flat pressure plate of a diameter of 85 cm was placed inside each container and covered 54% of the surface area of the contents and was positioned thereabove. Thus there was no contact during the test between the edge of the plate and the container fabric. The pressure plate was restrained from below by a rod passing through the base of the containers and the test material. An upward force was applied to the suspension frame by means of a hydraulic cylinder. The applied force was registered with an electronic load cell, amplifier and recorder system.

The containers were tested with a test sequence of 10 cycles at a test load of appr. 3000 kg before a final cycle to register the break load. The registered break loads are shown in Table 1.

TABLE 1

| Test No. | Container No. | Container construction | Place of rupture | Break load (kN) | Average break load (kN) | Average break load Percentage |
|---|---|---|---|---|---|---|
| 1220 | 1 | Top seam without friction area | Top seam | 42.5 | 46.3 | 100% |
| 1221 | 2 | Top seam without friction area | Top seam | 50.1 | | |
| 1222 | 3 | Top seam with mechan.achieved friction, 2 strings, pressing flaps and extensions together | Top seam | 62.0 | 60.5 | 130% |
| 1224 | 4 | Top seam with glue achieved friction to hold flaps and extensions together | Top seam | 59.0 | | |

The results clearly show that by adding an active friction area between flaps and extensions when integral extensions of the side wall structure are joined to form lifting loop(s), a substantial gain in strength (approx. 30%) is obtained, since the friction area relieves the seam of stress.

The simple method of cutting and joining the free ends of the extensions by interconnecting them or folding them to both sides of a folding line or seam will equalize the stress the joint or seam is exposed to when the filled container is lifted. Thus the invention results in containers having lifting loops with increased lifting capacity.

In some cases it is necessary to form lifting loops of different lengths along the two side edges to equalize the lifting height of the lifting loop across its width. A simple method to achieve equalized lifting loops from extensions 2,3 having different side edge lengths is described in NO-application No. 871705 (priority: Apr. 24, 1987 and not yet published). The two extensions 2 and 3 are first arranged as shown in FIG. 5, then they are displaced relative to one another such that their center lines form an angle before they are joined.

The containers described above and shown in the drawings each have only a single lifting loop, but it will be appreciated that the invention can be applied to a container having any number of lifting loops when the lifting loops are formed by joining according to the invention flaps and extensions of the side wall structure. It is further evident that the scope of the invention comprises joining of any number of flaps higher than two.

By the present invention one has succeeded in increasing the load carrying capacity of flexible containers with one or more lifting loops, when the loops are formed in the above stated manner.

Containers according to the present invention do not present any problems for use as intermediate bulk containers. Present filling and handling equipment can be used, since the modified lifting loops are completely compatible with earlier models.

We claim:

1. In an intermediate bulk container made from fabric-like material and including a base, side walls, and at least one lifting loop formed by joining integral extensions of said side walls, the improvements wherein:

each said extension includes an end portion defining plural flaps integral with the remainder of said extension;

said flaps of one said extension being positioned alternately over and under corresponding said flaps of the other said extension, and said flaps of said extensions being joined along a seam, thereby forming said at least one lifting loop of overlapping layers of said material; and means, positioned below said seam, for creating friction between said overlapped layers and thereby for increasing the strength of said lifting loop.

2. The improvement claimed in claim 1, wherein said extensions are defined by longitudinal separation between said side walls.

3. The improvement claimed in claim 1, wherein said lifting loop is gathered together to form a lifting handle.

4. The improvement claimed in claim 3, further comprising a sleeve fitted around said lifting handle.

5. The improvement claimed in claim 1, wherein said friction creating means comprises a glue or hot melt positioned between and securing said overlapped layers.

6. The improvement claimed in claim 1, wherein said friction creating means comprises mechanical means securing together said overlapped layers.

7. In an intermediate bulk container made from fabric-like material and including a base, side walls, and at least one lifting loop formed by joining integral extensions of said side walls, the improvements wherein:

each said extension includes an end portion defining plural flaps integral with the remainder of said extension;

said flaps of each said extension being positioned alternately over and under said remainder of the other said extension, and said flaps of said extensions being joined along a seam, thereby forming said at least one lifting loop of overlapping layers of said material; and means, positioned below said seam, for creating friction between said overlapped layers and thereby for increasing the strength of said lifting loop.

8. The improvement claimed in claim 7, wherein said extensions are defined by longitudinal separation between said side walls.

9. The improvement claimed in claim 7, wherein said lifting loop is gathered together to form a lifting handle.

10. The improvement claimed in claim 9, further comprising a sleeve fitted around said lifting handle.

11. The improvement claimed in claim 7, wherein said friction creating means comprises a glue or hot melt positioned between and securing said overlapped layers.

12. The improvement claimed in claim 7, wherein said friction creating means comprises mechanical means securing together said overlapped layers.

13. In an intermediate bulk container made from fabric-like material and including a base, side walls, and at least one lifting loop formed by joining integral extensions of said side walls, the improvements wherein:

each said extension includes an end portion defining a single flap integral with the remainder of said extension;

each said flap is folded over said remainder of the respective said extension such that said flap of a first said extension is positioned between said remainder of said extensions and said flap of a second said extension is positioned outwardly of said remainders of said extensions;

upper portions of the layers of material including said flaps and said remainders of said extensions are joined by a seam;

said flap of said second extension is folded over said seam; and means positioned below said seam, for creating friction between said flap of said second extension and the exterior of said remainder of said first extension and between said flap of said first extension and the interior of said remainder of said second extension, and thereby for increasing the strength of said lifting loop.

14. The improvement claimed in claim 13, wherein said flap of said second extension is secured to said exterior of said remainder of said first extension, and said flap of said first extension is secured to said interior of said remainder of said second extension.

15. The improvement claimed in claim 13, wherein said extensions are defined by longitudinal separation between said side walls.

16. The improvement claimed in claim 13, wherein said lifting loop is gathered together to form a lifting handle.

17. The improvement claimed in claim 16, further comprising a sleeve fitted around said lifting handle.

18. The improvement claimed in claim 13, wherein said friction creating means comprises a glue or hot melt.

19. The improvement claimed in claim 13, wherein said friction creating means comprises mechanical means.

* * * * *